United States Patent [19]

Ciko et al.

[11] 4,060,505

[45] * Nov. 29, 1977

[54] COMPOSITIONS FOR SOURING AND SOFTENING LAUNDERED TEXTILE MATERIALS AND STOCK SOLUTIONS PREPARED THEREFROM

[75] Inventors: John D. Ciko, Allen Park; John J. Cramer, Grosse Ile, both of Mich.

[73] Assignee: BASF Wyandotte Corporation, Wyandotte, Mich.

[ * ] Notice: The portion of the term of this patent subsequent to Oct. 5, 1993, has been disclaimed.

[21] Appl. No.: 718,219

[22] Filed: Aug. 27, 1976

Related U.S. Application Data

[63] Continuation-in-part of Ser. No. 541,448, Jan. 16, 1975, Pat. No. 3,984,335.

[51] Int. Cl.[2] ..... D06M 1/14; D06M 5/04

[52] U.S. Cl. ..... 252/8.8; 8/130.1; 428/411

[58] Field of Search ..... 252/8.8 R, 8.8 AK, 8.8 AM

[56] References Cited

U.S. PATENT DOCUMENTS

| | | | |
|---|---|---|---|
| 2,828,180 | 3/1958 | Sertorio | 8/62 |
| 2,877,178 | 3/1959 | Bergman et al. | 252/8.8 |
| 3,003,954 | 10/1961 | Brown | 252/8.8 |
| 3,546,115 | 12/1970 | Gill et al. | 252/8.8 |
| 3,681,241 | 8/1972 | Rudy | 252/8.75 |
| 3,743,534 | 7/1973 | Zamora | 177/109 |
| 3,775,316 | 11/1973 | Berg et al. | 252/8.8 |
| 3,795,610 | 3/1974 | Eckert et al. | 252/8.8 |
| 3,835,148 | 9/1974 | Oxe et al. | 260/29.6 MN |

*Primary Examiner*—Harold D. Anderson
*Assistant Examiner*—E. A. Nielsen
*Attorney, Agent, or Firm*—Bernhard R. Swick; L. S. Van Landingham, Jr.; Robert E. Dunn

[57] ABSTRACT

Liquid and solid compositions are provided for souring and imparting softness to freshly laundered textile materials. When in the form of a stable homogeneous liquid, the composition may contain a fatty amide of the class described more fully hereinafter as a softening agent, a water soluble organic acid containing about 1–20 carbon atoms and having a primary ionization constant between $10^{-1}$ and $10^{-5}$ as the souring agent, and water. When in the form of a stable dry solid, the composition may contain the aforementioned fatty amide as a softening agent, and a dry solid water soluble organic acid containing 2–20 carbon atoms and having a primary ionization constant between $10^{-1}$ and $10^{-5}$ as the souring agent. Stable homogeneous stock solutions are prepared from the novel liquid or solid compositions of the invention.

54 Claims, No Drawings

COMPOSITIONS FOR SOURING AND SOFTENING LAUNDERED TEXTILE MATERIALS AND STOCK SOLUTIONS PREPARED THEREFROM

RELATED APPLICATION

This application is a continuation-in-part of copending application Ser. No. 541,448 filed Jan. 16, 1975 on behalf of John D. Ciko and John A. Cramer for COMPOSITIONS FOR SOURING AND SOFTENING LAUNDERED TEXTILE MATERIALS AND STOCK SOLUTIONS PREPARED THEREFROM Application Ser. No. 541,448 is now U.S. Pat. No. 3,984,335.

THE BACKGROUND OF THE INVENTION

1. The Field of the Invention

This invention broadly relates to novel compositions for souring laundered textile materials and simultaneously imparting softness thereto. The invention further relates to stock solutions for souring and softening laundered textile materials prepared from the novel compositions.

2. The Prior Art

The fibers of textile materials tend to harden and lose their initial soft finish when laundered repeatedly. The dry laundered textile materials also may be harsh and irritating to the skin under some conditions. Softening finishes are applied for the purpose of imparting softness or restoring the softness properties and thereby overcoming these deficiencies. In most commercial laundries, the softening finish is applied during the souring operation which follows the washing step and several rinses to remove residual detergent. The final rinse may be the souring operation and the softening finish is conveniently applied at that time.

Quaternized fatty amines are excellent softening agents for textile materials and are widely used for this purpose. However, at best they are only slightly soluble or marginally dispersable in aqueous solutions of inorganic acids of the types most often used in the souring operation and relatively concentrated stable homogeneous liquid compositions or stock solutions cannot be prepared therefrom. It is therefore necessary to make separate additions of the softening agent and the souring agent to the final rinse water in the washer. These separate additions, in turn, require maintaining separate inventories of the softening agent and the souring agent, separate auxiliary storage facilities therefor while awaiting use, and separate apparatus for making each of the two additions to modern commercial washers.

A suitable stable homogeneous composition containing the proper proportion and concentrations of the softening agent and the souring agent would possess a number of advantages which are attractive from the standpoints of convenience and efficiency. This is especially true when operating modern commercial laundry equipment of the type wherein bulk liquid washing chemicals are stored in auxiliary tanks and are added automatically to the washer through feed conduits at predetermined stages in the washing cycle. Entirely satisfactory compositions having the aforementioned characteristics were not available prior to the present invention due in part to the incompatible nature of the softening agents and the inorganic acid species which are commonly used as souring agents. If available, such compositions would allow the initial construction costs of commercial laundries to be reduced substantially as separate auxiliary apparatus would not be needed for storing and adding each ingredient. Labor and general operating costs would also be reduced substantially as only one addition need be made.

THE SUMMARY OF THE INVENTION

The compositions disclosed herein overcome the aforementioned deficiencies of the prior art. The present invention provides a novel stable homogeneous liquid composition and a novel dry solid composition for simultaneously souring and imparting softness to freshly laundered textile materials. In one variant, a stable homogeneous aqueous liquid composition is provided which contains a specific class of fatty amide softening agents and organic souring agents compatible therewith. A stable dry solid composition is provided in a further variant which contains the above-mentioned fatty amide and organic souring agents compatible therewith. Novel stable homogeneous aqueous stock solutions are also prepared from the liquid or solid compositions of the invention.

The following detailed description and the specific examples may be referred to for a more complete and comprehensive understanding of the invention.

THE DETAILED DESCRIPTION OF THE INVENTION INCLUDING THE PREFERRED VARIANTS AND EMBODIMENTS THEREOF

In accordance with one presently preferred variant of the invention, stable homogeneous liquid compositions for souring freshly laundered textile materials and imparting softness thereto are provided which contain about 0.5–25% by weight and preferably about 1–15% by weight of a fatty amide softening agent to be described more fully hereinafter, about 7.5–75% by weight and preferably about 7.5–55% by weight of an organic acid souring agent, and about 0.9–0% by weight and preferably about 30–91.5% by weight of water. In accordance with another presently preferred variant of the invention, stable dry solid compositions for souring freshly laundered textile materials and imparting softness thereto are provided which contain about 5–50% by weight and preferably about 15–30% by weight of the aforementioned softening agent, and about 50–95% by weight and preferably about 70–85% by weight of an organic acid souring agent. It will be appreciated that there are certain preferred variants and embodiments of the invention which are discussed in greater detail hereinafter. All quantities and percentages mentioned hereinafter and recited in the claims are calculated on a weight basis unless indicated to the contrary.

The aforementioned liquid composition of the invention contains a fatty amide softening agent for textile materials or admixtures of two or more fatty amide softening agents corresponding to the following structural formula $$R-\overset{\overset{\displaystyle O}{\|}}{C}-\overset{\overset{\displaystyle R_2}{|}}{N}-(\overset{\overset{\displaystyle R_3}{|}}{C}H-\overset{\overset{\displaystyle R_3}{|}}{C}H-O)_m-H$$

wherein R is selected from the group consisting of monovalent alkyl radicals and sulfonated monovalent alkyl radicals containing about 8–22 carbon atoms, $R_2$ is selected from the group consisting of hydrogen and

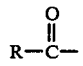

wherein R is as defined above, $R_3$ is selected from the group consisting of hydrogen and monovalent alkyl radicals containing 1–2 carbon atoms, and *m* is 2–6. The liquid compositions also contains a water soluble organic acid having a primary ionization constant between about $10^{-1}$ and $10^{-5}$ and containing about 1–20 carbon atoms, and preferably about 1–10 carbon atoms, as an acidic souring agent for the laundered textile materials or admixtures of two or more of such organic acids. The presently preferred organic carboxylic acids include acetic acid, citric acid, glycolic acid, maleic acid, malonic acid, oxalic acid and tartaric acid. Glycolic acid or citric acid usually produce the best results.

In the foregoing structural formula, R is preferably a monovalent alkyl radical containing about 12–18 Carbon atoms and for still better results about 17 or 18 carbon atoms. $R_2$ is preferably

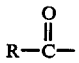

wherein R is as defined above, and $R_3$ is preferably hydrogen. The numerical value of *m* is preferably 2 or 3.

The fatty amides disclosed herein are well known commercially available products and may be prepared in accordance with the usual prior art processes. The fatty amide softening composition sold under the tradename Ceranine PNS® is presently preferred, but is understood that other fatty amides having the structural formula set out hereinbefore may be used. The liquid composition preferably contains glycolic acid as the souring agent in instances where freeze-thaw stability is of importance. These latter liquid compositions reconstitute upon freezing and thawing and a precipitate or other nonhomogeneous phase is not formed.

It is understood that the aforementioned ingredients are present in proportions and in concentrations whereby a stable homogeneous liquid composition is produced. In most instances, the preferred concentrations and proportions of the ingredients may be determined by the Box or Factorial Methods of Experimental Design. Suitable procedures for making such determinations are disclosed in the text *Design and Analysis of Industrial Experiments,* edited by Owen L. Davies, and published by the Hafner Publishing Company, New York, New York (1956), the disclosure of which is incorporated herein by reference. This test has been assigned Library of Congress Card No. T 175.D 3. Chapters 10 and 11, i.e., pages 440–578, are especially pertinent.

The dry solid composition of the invention contains a fatty amide having the aforementioned structural formula, or an admixture of two or more of such fatty amides. The solid composition also contains a dry solid water soluble organic acid having primary ionization constant between $10^{-1}$ and $10^{-5}$ and containing about 2–20 carbon atoms, and preferably about 2–10 carbon atoms, or admixtures of two or more of such organic acids. The presently preferred organic carboxylic acids for the solid composition include citric acid, fumaric acid, glycolic acid, maleic acid, malonic acid, oxalic acid and tartaric acid. Citric acid or glycolic acid is usually preferred. Inasmuch as the above described fatty amides and organic acid souring agents are dry solids and are compatible, the composition may be prepared by uniformly admixing the ingredients in the proportions and concentrations disclosed herein to thereby produce a stable substantially homogeneous solid composition.

In instances where the solid composition is to be admixed with water to prepare a stock solution, then the preferred souring agent is citric acid and/or glycolic acid. Citric acid and/or glycolic acid produce especially stable and homogeneous stock solutions. However, glycolic acid is deliquesecent and care must be taken to keep it dry during preparation of the solid composition and subsequently during storage. Citric acid is available in the anhydrous form commercially and thus is preferred in most instance.

The liquid and solid compositions of the invention are stable and honogeneous, and may be stored for long periods of time while awaiting use. Either composition may be added directly to the addition wheel of modern commercial washers. Inasmuch as the compositions are homogeneous or substantially homogeneous, simultaneous additions of the active softening agent and souring agent may be made in the exact required amounts at the proper time in the washing cycle using automatic prior art metering or measuring apparatus and timing devices. Only the one addition need be made for the souring agent and the softening agent, and thus the auxiliary apparatus needed for storing, handling and adding softening and souring chemicals is reduced by approximately one-half. The labor and inventory costs are lower thereby effecting further economies in the overall laundering operation. The compositions of the present invention also assure that the softening agent and souring agent are added in the proper proportions, as well as in the proper concentrations, thereby simplifying the addition procedure. Unskilled or inexperienced personnel may be relied upon for making the proper additions.

The liquid and solid compositions of the invention may be added to the final rinse water, or they may be added at other suitable times in the washing cycle. Conventional practice may be followed with the exception of substituting one addition of the compositions of the invention for the two additions of the softening agent and souring agent of the prior art. The compositions are added in amounts sufficient to provide the usual prior art quantities of active softening agent and active souring agent. For example, the liquid or solid composition may be added to the final rinse water in an amount to provide approximately 0.25–5 ounces and preferably about 0.25–3 ounces of the active softening agent and about 0.5–10 ounces and preferably about 1–2 ounces of the active souring agent per 100 pounds of dry textile material. While these quantities of softening agent and souring agent are generally satisfactory, it is understood that larger or smaller amounts may be added as needed in specific instance.

The foregoing detailed description and the following specific examples are for purposes of illustration only, and are not intended as being limiting to the spirit or scope of the appended claims.

EXAMPLE I

This example illustrates the preparation of a stable homogeneous solution containing a commercially available fatty amide softening composition sold under the tradename Ceranine PNS ® and glycolic acid as a souring agent.

The composition contained 1.3% of the fatty amide, 8.5% of glycolic acid, and the remainder water. The ingredients were admixed and allowed to stand in the laboratory for over two months. The solution was observed periodically and it remained stable and homogeneous.

EXAMPLE II

This example illustrates the use of a liquid composition containing 1.3% by weight of the fatty amide softening agent sold under the tradename Ceranine PNS ®, 8.5% by weight of glycolic acid and the remainder water for simultaneously souring and softening freshly laundered textile materials.

A 25 pound Milnor Washer-Extractor was used in this example. A wash net was filled with 25 pounds of Dacron-cotton filler. Swatches of 4 × 4 inches terry-cloth were also placed in the net and the filled net was placed in the washer. The washer was filled with 6 inches of water having a temperature of 160° F., 4 ounces of a mixture containing equal weights of sodium carbonate and anhydrous sodium metasilicate was added, and the load was washed for a period of 30 minutes. During the second or carry over operation which followed, the washer was run for 5 minutes at the 6 inch water level. The water had a temperature of 160° C., and no chemicals were added. The third operation was carried out for 2 minutes using the flush 12 inch water level. The water had a temperature of 160° F. and no chemicals were added.

The fourth operation was the bleach and trichlorocyanuric acid was used as the bleaching agent. The water level was 6 inches, the temperature was 160° F., and the bleaching time was seven minutes. The bleach was followed by the fifth and sixth operations which were rinses. The water level was 12 inches in each rinse, the water temperature was 140° F. and 120° F. respectively, and the rinse time was 2 minutes in each rinse.

The seventh operation was the souring-softening step and several of the washed swatches were removed for use in the tests which follow. The water level was 6 inches and the water temperature was 100° F. The souring-softening addition was 600 milliliters of a liquid composition containing 1.3% by weight of a fatty amide sold under the tradename Ceranine PNS ®, 8.75% by weight of glycolic acid and the remainder water. The souring-softening composition was added in an amount to provide one ounce of the active softening agent per hundred-weight of textile material. Thereafter the load was hydroextracted for 30 seconds and tumble dried.

The pH of the wash water was 11.2. The pH of the water from the souring-softening operation was 3.8 thereby indicating a reversal in pH. The pH of the washed textile material was 4.5–5.5, which demonstrates that it was properly soured.

Four sets of swatches were prepared containing one of the softened swatches and one of the untreated swatches. The four sets of swatches were examined by different individuals and each immediately distinguished between the softened swatch and the untreated swatch. Thus the treated swatches were adequately softened.

The above swatches were further tested in a standard wicking test. A dye solution was prepared and the samples were partially immersed therein. The time required for the dye solution to wick 1 and 2 inches up on the swatch was determined in seconds. The untreated swatches wicked 2 inches after 25–30 seconds. The softened swatches did not wick 1 inch in 1,000 seconds, thereby demonstrating that the softening agent is substantitive to the fabric.

EXAMPLE III

This example illustrates the preparation of a dry solid composition in accordance with the invention which is useful in the souring of freshly laundered textile materials and simultaneously imparting softness properties. A composition is prepared containing 20% by weight of the fatty amide sold under the tradename Ceranine PNS ® as a softening agent, about 80% by weight of anhydrous citric acid, and small amounts of perfume and dye. The dry ingredients are finely subdivided and then admixed thoroughly to form a substantially homogeneous dry solid composition. There is no indication of decomposition or caking upon observing the resultant composition in the lab for several days and thus the dry solid composition is stable.

Following the above described observation period, the dry composition is admixed with sufficient water to produce a liquid composition containing about 2% by weight of the fatty amide softening agent and about 8% by weight of the citric acid souring agent. Upon testing the liquid composition thus prepared following the general procedure of Example II, the results are comparable to the results reported in Example II. Thus, the dry solid composition of the invention is capable of being stored over long periods of time and then used in preparing a liquid composition in accordance with the invention which is capable of simultaneously souring and softening washed textile materials.

We claim:

1. A stable homogeneous liquid composition for souring laundered textile materials and imparting softness thereto consisting essentially of I. 0.5–25% by weight of a fatty amide softening agent for textile materials corresponding to the structural formula

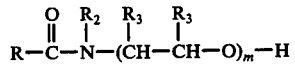

wherein R is selected from the group consisting of monovalent alkyl radicals and sulfonated monovalent alkyl radicals containing about 8–22 carbon atoms, $R_2$ is selected from the group consisting of hydrogen and

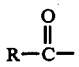

wherein R is as defined above, $R_3$ is selected from the group consisting of hydrogen and monovalent alkyl radicals containing 1–2 carbon atoms, and *m* is 2–6;

II. 7.5–75% by weight of an acidic souring agent for laundered textile materials, the souring agent being a water soluble organic carboxylic acid containing about 1–20 carbon atoms and having a primary ionization constant between about $10^{-1}$ and $10^{-5}$, and III. 0–92% by weight of water;

the said ingredients I and II being present in amounts whereby laundered textile materials are effectively softened and simultaneously soured upon treatment with the said liquid composition, and the said ingredients I, II and III being present in amounts whereby a stable homogeneous liquid composition is produced.

2. The liquid composition of claim 1 wherein the softening agent is present in an amount of 1–15% by weight.

3. The liquid composition of claim 1 wherein the souring agent is present in an amount of 7.5–55% by weight.

4. The liquid composition of claim 1 wherein the softening agent is present in an amount of 1–15% by weight, the souring agent is present in an amount of 7.5–55% by weight, and water is present in an amount of 30–91.5% by weight.

5. The liquid composition of claim 1 wherein the souring agent is selected from the group consisting of acetic acid, citric acid, glycolic acid, maleic acid, malonic acid, oxalic acid and tartaric acid.

6. The liquid composition of claim 1 wherein the souring agent is glycolic acid.

7. The liquid composition of claim 1 wherein the souring agent is citric acid.

8. The liquid composition of claim 1 wherein R is a monovalent alkyl radical containing about 12–18 carbon atoms.

9. The liquid composition of claim 1 wherein $R_2$ is hydrogen.

10. The liquid composition of claim 1 wherein $R_2$ is $$R-\overset{\overset{\displaystyle O}{\|}}{C}-.$$

11. The liquid composition of claim 1 wherein $R_3$ is hydrogen.

12. The liquid composition of claim 1 wherein *m* is 2–3.

13. The liquid composition of claim 1 wherein R is a monovalent alkyl radical containing about 12–18 carbon atoms and $R_2$ is $$R-\overset{\overset{\displaystyle O}{\|}}{C}-.$$

14. The liquid composition of claim 13 wherein *m* is 2–3.

15. The liquid composition of claim 14 wherein $R_3$ is hydrogen.

16. The liquid composition of claim 15 wherein the souring agent is selected from the group consisting of acetic acid, citric acid, glycolic acid, maleic acid, malonic acid, oxalic acid and tartaric acid.

17. The liquid composition of claim 16 wherein R contains 17 carbon atoms and *m* is 2.

18. The liquid composition of claim 1 wherein R is a monovalent alkyl radical containing about 12–18 carbon atoms and $R_2$ is H.

19. The liquid composition of claim 18 wherein $R_3$ is hydrogen.

20. The liquid composition of claim 19 wherein *m* is 2–3.

21. The liquid composition of claim 20 wherein the souring agent is selected from the group consisting of acetic acid, citric acid, glycolic acid, maleic acid, malonic acid, oxalic acid and tartaric acid.

22. The liquid composition of claim 21 wherein R contains 17 carbon atoms and *m* is 2.

23. A stable dry solid composition for souring laundered textile materials and imparting softness thereto consisting essentially of I. 5–50% by weight of a fatty amide softening agent for textile materials corresponding to the structural formula $$R-\overset{\overset{\displaystyle O}{\|}}{C}-\overset{\overset{\displaystyle R_2}{|}}{N}-(\overset{\overset{\displaystyle R_3}{|}}{CH}-\overset{\overset{\displaystyle R_3}{|}}{CH}-O)_m-H$$

wherein R is selected from the group consisting of monovalent alkyl radicals and sulfonated monovalent alkyl radicals containing about 8–22 carbon atoms, $R_2$ is selected from the group consisting of hydrogen and $$R-\overset{\overset{\displaystyle O}{\|}}{C}-$$

wherein R is as defined above, $R_3$ is selected from the group consisting of hydrogen and monovalent alkyl radicals containing 1–2 carbon atoms, and *m* is 2–6; and II. 95–90% by weight of an acidic souring agent for laundered textile materials, the souring agent being a dry solid water soluble organic carboxylic acid containing about 2–20 carbon atoms and having a primary ionization constant between about $10^{-1}$ and $10^{-5}$.

the said ingredients I and II being present in amounts whereby laundered textile materials are effectively softened and simultaneously soured upon treatment with an aqueous solution for souring textile materials containing the said dry solid composition, and the said ingredients I and II being present in amounts whereby a stable solid composition is produced for souring laundered textile materials and imparting softness thereto.

24. The dry solid composition of claim 23 wherein the composition contains 15–30% by weight of the softening agent and 70–85% by weight of the souring agent.

25. The dry solid composition of claim 23 wherein the souring agent is selected from the group consisting of citric acid, fumaric acid, glycolic acid, maleic acid, malonic acid, oxalic acid and tartaric acid.

26. The dry solid composition of claim 23 wherein the souring agent is citric acid.

27. The dry solid composition of claim 23 wherein the souring agent is glycolic acid.

28. The dry solid composition of claim 23 wherein R is a monovalent alkyl radical containing about 12–18 carbon atoms.

29. The dry solid composition of claim 23 wherein $R_2$ is hydrogen.

30. The dry solid composition of claim 23 wherein $R_2$ is $$R-\overset{\overset{\displaystyle O}{\|}}{C}-.$$

31. The dry solid composition of claim 23 wherein $R_3$ is hydrogen.

32. The dry solid composition of claim 23 wherein *m* is 2–3.

33. The dry solid composition of claim 23 wherein R is a monovalent alkyl radical containing about 12–18 carbon atoms and $R_2$ is $$R-\overset{\overset{\displaystyle O}{\|}}{C}-.$$

34. The dry solid composition of claim 33 wherein *m* is 2–3.

35. The dry solid composition of claim 34 wherein $R_3$ is hydrogen.

36. The dry solid composition of claim 35 wherein the souring agent is selected from the group consisting of citric acid, fumaric acid, glycolic acid, maleic acid, malonic acid, oxalic acid and tartaric acid.

37. The dry solid composition of claim 36 wherein R contains 17 carbon atoms and *m* is 2.

38. The dry solid composition of claim 23 wherein R is a monovalent alkyl radical containing about 12–18 carbon atoms and $R_2$ is H.

39. The dry solid composition of claim 38 wherein $R_3$ is hydrogen.

40. The dry solid composition of claim 39 wherein *m* is 2–3.

41. The dry solid composition of claim 40 wherein the souring agent is selected from the group consisting of citric acid, fumaric acid, glycolic acid, maleic acid, malonic acid, oxalic acid and tartaric acid.

42. The dry solid composition of claim 41 wherein R contains 17 carbon atoms and *m* is 2.

43. A stable homogeneous aqueous stock solution for souring and softening laundered textile materials prepared by diluting the liquid composition of claim 1 with water.

44. A stable homogeneous aqueous stock solution for souring and softening laundered textile materials prepared by diluting the liquid composition of claim 5 with water.

45. A stable homogeneous aqueous stock solution for souring and softening laundered textile materials prepared by diluting the liquid composition of claim 13 with water.

46. A stable homogeneous aqueous stock solution for souring and softening laundered textile materials prepared by diluting the liquid composition of claim 17 with water.

47. A stable homogeneous aqueous stock solution for souring and softening laundered textile materials prepared by diluting the liquid composition of claim 18 with water.

48. A stable homogeneous aqueous stock solution for souring and softening laundered textile materials prepared by diluting the liquid composition of claim 22 with water.

49. A stable homogeneous aqueous stock solution for souring and softening laundered textile materials prepared by admixing the dry solid composition of claim 23 with water.

50. A stable homogeneous aqueous stock solution for souring and softening laundered textile materials prepared by admixing the dry solid composition of claim 25 with water.

51. A stable homogeneous aqueous stock solution for souring and softening laundered textile materials prepared by admixing the dry solid composition of claim 33 with water.

52. A stable homogeneous aqueous stock solution for souring and softening laundered textile materials prepared by admixing the dry solid composition of claim 37 with water.

53. A stable homogeneous aqueous stock solution for souring and softening laundered textile materials prepared by admixing the dry solid composition of claim 38 with water.

54. A stable homogeneous aqueous stock solution for souring and softening laundered textile materials prepared by admixing the dry solid composition of claim 42 with water.

* * * * *

UNITED STATES PATENT AND TRADEMARK OFFICE

CERTIFICATE OF CORRECTION

PATENT NO. : 4,060,506

DATED : Nov. 29, 1977

INVENTOR(S) : Frank Verbanac

It is certified that error appears in the above-identified patent and that said Letters Patent are hereby corrected as shown below:

Column 4, bridging lines 49 and 50; for "$-(CH_2-C(CH_3)H-C)-_{nl}(CH_2C(CH_3)H-O-$" read --- $-(CH_2-C(CH_3)H-O)_{nl}-CH_2C(CH_3)H-O-$ ---

Column 5, bridging lines 62 and 63; for "3(N-methylol acyrlamido)-3-methyl butyl" read --- 3-(N-methylol acrylamido)-3-methyl butyl---

Column 6, line 27; for "connected" read ---conducted---

Column 7, line 12; for "temperature as" read ---temperature or as---

Column 7, line 59; for "arylamide" read ---acrylamide---

Column 11, line 49; for "upon a water" read ---upon water---

Column 14, line 2; for "watersoluble" read ---water-soluble---